US011683871B2

(12) United States Patent
Sasaki

(10) Patent No.: US 11,683,871 B2
(45) Date of Patent: Jun. 20, 2023

(54) ELECTRONIC DEVICE AND CONTROL METHOD THEREOF

(71) Applicant: CANON KABUSHIKI KAISHA, Tokyo (JP)

(72) Inventor: Hidemi Sasaki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 147 days.

(21) Appl. No.: 17/221,572

(22) Filed: Apr. 2, 2021

(65) Prior Publication Data

US 2021/0321500 A1 Oct. 14, 2021

(30) Foreign Application Priority Data

Apr. 8, 2020 (JP) ..... JP2020-069491

(51) Int. Cl.
*H05B 45/325* (2020.01)
*H05B 45/14* (2020.01)
*H05B 45/3725* (2020.01)
*H05B 45/44* (2020.01)

(52) U.S. Cl.
CPC ..... *H05B 45/325* (2020.01); *H05B 45/14* (2020.01); *H05B 45/3725* (2020.01); *H05B 45/44* (2020.01)

(58) Field of Classification Search
CPC .. H05B 45/44; H05B 45/3725; H05B 45/325; H05B 45/14; H05B 45/10; G09G 2330/02; G09G 2320/064; G09G 2320/0606; G09G 3/3406
See application file for complete search history.

(56) References Cited

U.S. PATENT DOCUMENTS 9,514,689 B2 * 12/2016 Lee ..... G09G 3/3426
11,083,061 B1 * 8/2021 Rodriguez ..... H05B 45/10
2006/0232216 A1 * 10/2006 Kosaka ..... G09G 3/3406 315/169.3
2017/0094743 A1 * 3/2017 Chen ..... H02J 7/35
2020/0029408 A1 * 1/2020 Chen ..... G06F 3/04886

FOREIGN PATENT DOCUMENTS

JP 2011233261 A 11/2011
JP 2012150911 A * 8/2012

OTHER PUBLICATIONS

Machine Translation of JP-2012150911-A (Year: 2012).*

* cited by examiner

*Primary Examiner* — Raymond R Chai
(74) *Attorney, Agent, or Firm* — Canon U.S.A., Inc. IP Division

(57) ABSTRACT

An image formation device is provided which includes a variable resistor of which a resistance value changes in accordance with a user operation, an A/D converter that outputs information relating to a voltage applied to the variable resistor, and a pulse width modulation (PWM) controller that outputs a PWM signal having a duty ratio determined based on the information output by the A/D converter. The PWM controller outputs the PWM signal that has the duty ratio determined based on the information input with reference to a timing for inverting a logic state of the PWM signal.

10 Claims, 5 Drawing Sheets

ELECTRONIC DEVICE AND CONTROL METHOD THEREOF

BACKGROUND

Field

The present disclosure relates to an electronic device that performs pulse width modulation (PWM) control based on a value of a voltage applied to a variable resistor of which the resistance value is changed in accordance with a user operation.

Description of the Related Art

The luminance of a display unit can be adjusted in accordance with a user's environment. For example, there is known an operation unit that includes a display unit, a rotary variable resistor, a luminance adjustment dial connected to the variable resistor, and a microcomputer. In a case where the user rotates the luminance adjustment dial, a resistance value of the variable resistor changes in accordance with the rotation angle of the luminance adjustment dial. The microcomputer determines luminance of the display unit, based on a voltage value of a terminal for voltage measurement electrically connected to the variable resistor (hereinafter, referred to as a voltage measurement terminal).

The voltage value measurement can be performed using, for example, an analog-digital converter (hereinafter, referred to as A/D converter). The A/D converter is an electric circuit that accumulates voltages of an analog signal for a predetermined time period and recognizes the accumulated voltages as a digital signal. The A/D converter is often included in built-in functions of the microcomputer.

The luminance of the display unit can be adjusted by pulse width modulation (PWM). The PWM is a technique for reproducing an intermediate output signal between high and low using a ratio between a time period during which an output signal is high and a time period during which an output signal is low (duty ratio). For example, a 50% output signal between high and low can be reproduced by alternately repeating highs and lows for the same durations within a very short time. Japanese Patent Application Laid-Open No. 2011-233261 discusses a switching power source that adjusts a drive voltage for a light emitter element by PWM. The PWM can be implemented by a timer function built in the microcomputer.

The operation unit of an image forming apparatus desirably has a smaller number of terminals connected to a main unit from the viewpoint of cost reduction. Thus, a backlight, a luminance dial, and a voltage measurement terminal are desirably connected in parallel to the same power source.

When electric current flows to a power line connecting the power source and the display unit, a voltage decreases in the power line having a resistance component. In a case where the voltage measurement terminal of the microcomputer is connected to the power line, the voltage of the voltage measurement terminal also decreases. Then, when the electric current flowing to the power line becomes small, decrease of the voltage in the power line also becomes small. Consequently, even though the user does not operate the luminance dial, the voltage of the voltage measurement terminal changes, and the luminance of the display unit changes along with the voltage change.

SUMMARY

Various embodiments of the present disclosure provide techniques and mechanisms for reducing or preventing an output change due to PWM control without additional hardware.

According to various embodiments of the present disclosure, an electronic device includes a variable resistor of which a resistance value changes in accordance with a user operation, a load, a power source that applies a voltage to the variable resistor and the load, and a controller that acquires information relating to the voltage applied to the variable resistor and outputs a pulse width modulation (PWM) signal for turning on or off the load, the PWM signal having a duty ratio determined based on the acquired information, wherein the controller acquires the information based on a cycle of the PWM signal.

Further features of the present disclosure will become apparent from the following description of exemplary embodiments with reference to the attached drawings.

DESCRIPTION OF THE EMBODIMENTS

Hereinafter, an exemplary embodiment for carrying out various embodiments of the present disclosure will be described with reference to the drawings. Various embodiments of the present disclosure are applicable to general electronic devices including information processing apparatuses, such as PCs, and home appliances, such as refrigerators. As the present exemplary embodiment, an image forming apparatus to which various embodiments are applied will be described.

Figure 1:
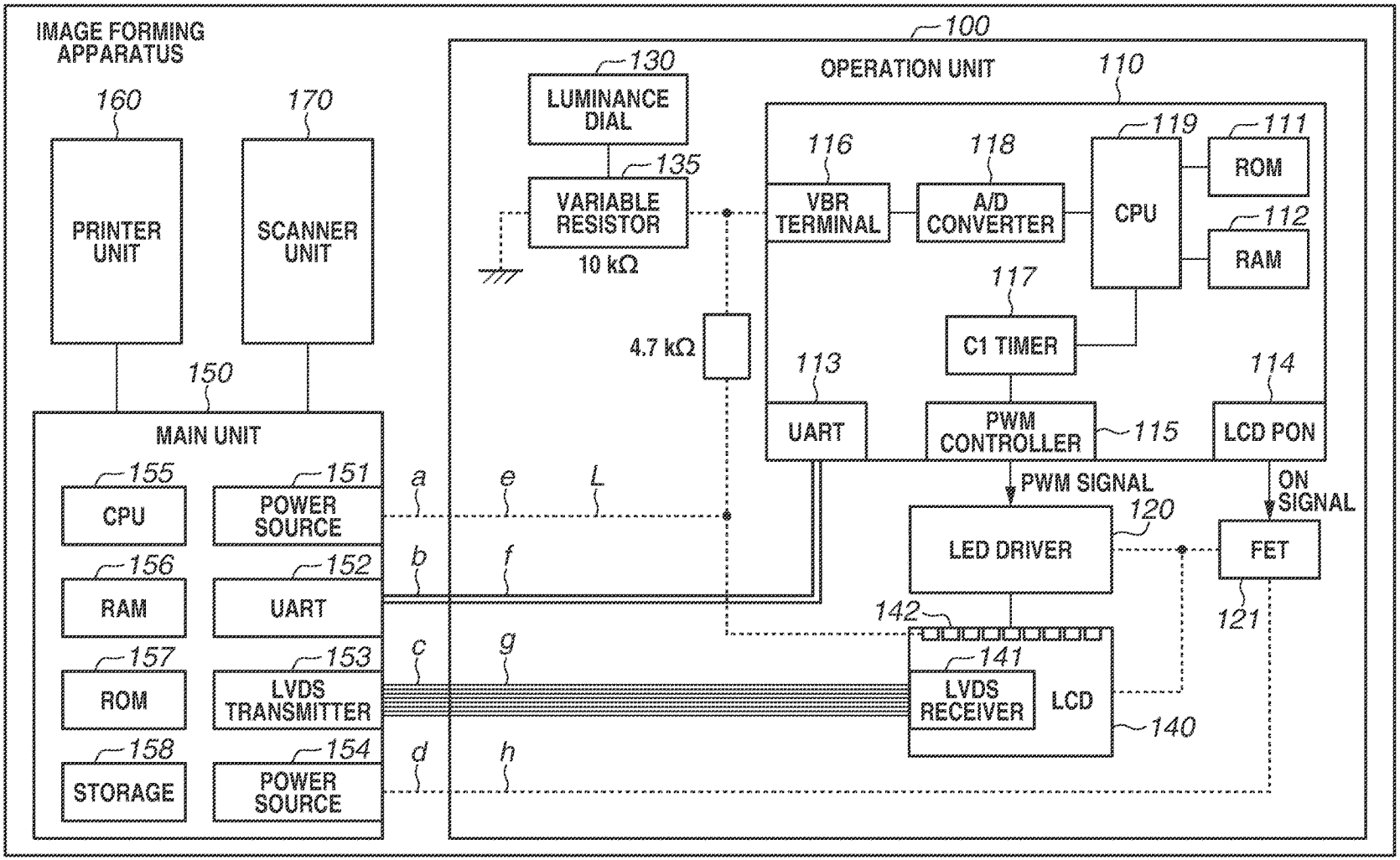
FIG. 1 is a schematic diagram illustrating a hardware configuration of an exemplary embodiment according to one embodiment.

FIG. 1 is a schematic diagram illustrating a hardware configuration of an exemplary embodiment according to one embodiment.

An image forming apparatus 1 includes a main unit 150, a scanner unit 170, a printer unit 160, and an operation unit 100. A control substrate of the main unit 150 and a control substrate of the operation unit 100 are different from each other. The control substrate of the main unit 150 and the control substrate of the operation unit 100 are connected with each other by a line bundle. The line bundle has a plurality of signal lines and a plurality of power lines. The scanner unit 170 is a unit that reads an image on a set document, generates image data, and transmits the image data to the main unit 150, in accordance with a request from the main unit 150. The printer unit 160 is a unit that prints image data formed by the main unit 150 on a printing medium, in accordance with a request from the main unit 150.

The main unit 150 includes a CPU 155, a RAM 156, a ROM 157, a storage 158.

The main unit 150 and the operation unit 100 include a universal asynchronous receiver/transmitter (UART) 152 and a UART 113, respectively. The main unit 150 includes a low voltage differential signaling (LVDS) transmitter 153 for transmitting image data to be displayed on an LCD 140. The operation unit 100 is provided with an LVDS receiver 141 that receives image data from the LVDS transmitter 153.

<Main Unit 150>

The main unit 150 serves as a controller that controls the units of the image forming apparatus 1 (the printer unit 160, the scanner unit 170, and the operation unit 100). The main unit 150 has a power source 151 that supplies a voltage of about 5.0 V, the UART 152, the LVDS transmitter 153, and a power source 154 that supplies a voltage of about 3.3 V. The main unit 150 has a power terminal a connected to the power source 151, a terminal b connected to the UART 152, a terminal c connected to the LVDS transmitter 153, and a power terminal d connected to the power source 154.

The main unit 150 and the scanner unit 170 are connected together by a signal line that transmits and receives image data and control commands. The main unit 150 and the printer unit 160 are connected together by a signal line that transmits and receives image data and control commands.

<Operation Unit 100>

The operation unit 100 has terminals e to h that correspond to the above-described terminals a to d, respectively.

The operation unit 100 includes a microcomputer 110, an LED driver (light emitter controller) 120, a FET 121, a luminance dial 130, a variable resistor 135, and a liquid crystal display (LCD) 140.

The microcomputer 110 is a central arithmetic processing device that executes firmware for controlling the operation unit 100. The microcomputer 110 operates by power supplied from the power source 154 of the main unit 150. The microcomputer 110 includes a flash ROM 111 that stores the firmware, a random access memory (RAM) 112 where the firmware is unpacked at the time of execution of the firmware, and a CPU 119 that executes the unpacked firmware in the RAM 112.

The microcomputer 110 includes the UART 113 that communicates with the UART 152 of the main unit 150. The UART 113 receives a control command from the UART 152 of the main unit 150 and transmits a control response as a response to the command. The UART 113 can also transmit a control command to the main unit 150 and receive a control response as a response to the command.

The microcomputer 110 includes an LCD PON 114 that controls power supply to the LED driver 120 and the LCD 140. The LCD PON 114 controls the power supply to the LED driver 120 and the LCD 140 by turning on or off the FET 121. The microcomputer 110 also includes a pulse width modulation (PWM) controller (PWM signal output unit) 115 that communicates with the LED driver 120.

The microcomputer 110 includes a VBR terminal 116 for measuring the voltage value of the variable resistor. The VBR terminal 116 is electrically connected to the variable resistor 135. The microcomputer 110 also includes a C1 timer 117 that is used for PWM control. The C1 timer 117 has a clock frequency indicating one cycle and a threshold for changing a signal. The threshold for changing a signal is determined based on a voltage of the VBR terminal 116. The C1 timer 117 adds up the clock frequency during operation. When the counted clock frequency has reached the threshold, the C1 timer (timing controller) 117 outputs an interrupt to the PWM controller 115. When the counted clock frequency has reached the clock frequency indicating one cycle, the C1 timer 117 also outputs an interrupt to the PWM controller 115. Upon input of the interrupt, the PWM controller 115 inverts the logic state of the PWM signal to be output. In a case of setting the luminance of the LED of the LCD 140 to 70%, the duty ratio of the PWM signal to be output by the PWM controller 115 is set to 70%.

The microcomputer 110 includes an A/D converter (voltage output unit) 118 for measuring a voltage applied to the VBR terminal 116. The A/D converter 118 can summarize voltages applied during a predetermined time period. The A/D converter 118 divides the summarized voltages by the measurement time to calculate an average voltage in a measurement interval. The C1 timer 117 determines the above-described threshold to be set to the C1 timer, based on the average voltage calculated by the A/D converter 118. The threshold may be determined based on the voltage output by the A/D converter 118.

The LED driver 120 is an LED control chip that turns on and off one or more LEDs 142 included in a backlight of the LCD 140. When the LCD PON 114 of the microcomputer 110 outputs an ON signal, the FET 121 is turned on and the power source 154 supplies power to the LED driver 120. Accordingly, the LED driver 120 is activated. The PWM controller 115 then turns on or off an internal switch based on a PWM signal to control current flowing to the LED 142. This changes the luminance of the LED 142.

The FET 121 is a field-effect transistor. The FET 121 is a switch that supplies or stops power from the power source terminal d connected to the power source 154. The FET 121 turns on or off based on a signal from the LCD PON 114 of the operation unit 100. Accordingly, the power from the power source 154 is supplied to the LED driver 120 and the LCD 140 or is stopped.

The luminance dial 130 is a user interface for the user to set the luminance of the LED 142 of the LCD 140. The luminance dial 130 is connected to the variable resistor 135 of the rotary type resistor. When the user rotates the luminance dial 130, a resistance value of the variable resistor 135 changes. A voltage supplied from the power source 151 of the main unit 150 is applied to the variable resistor 135, the VBR terminal 116 of the microcomputer 110, and the LED driver 120. A voltage from the power source 151 of the main unit 150 is also applied to the LED 142 of the backlight of the LCD 140. If a resistance value of the variable resistor 135 is large, the voltage applied to the VBR terminal 116 becomes higher. If a resistance value of the variable resistor 135 is small, the voltage applied to the VBR terminal 116 becomes lower.

The LCD 140 has a liquid crystal panel and a backlight. The liquid crystal panel displays an image based on the image data transmitted from the LVDS transmitter 153 of the main unit 150. The backlight includes one or more LEDs 142. When the LCD PON 114 of the microcomputer 110 outputs a signal, the power from the power source 154 is supplied to the LCD 140 via the FET 121. The LED of the backlight of the LCD 140 turns on or off under control of the LED driver 120. The electric current to the LED 142 changes by the control of the LED driver 120. Accordingly, the luminance of the LED 142 changes. The LCD 140 displays an image on the liquid crystal panel based on the image signal output from the LVDS transmitter 153.

The operation unit 100 may include buttons for accepting user operations, a touch panel that detects a touch on an image displayed, a buzzer and LED for issuing a warning to the user, and the like.

The power source 151 supplies voltages to the LED 142 of the LCD 140, the variable resistor 135, and the VBR terminal 116. The power source 151, the LED 142, the variable resistor 135, and the VBR terminal 116 are connected to a power line L.

Figure 2:
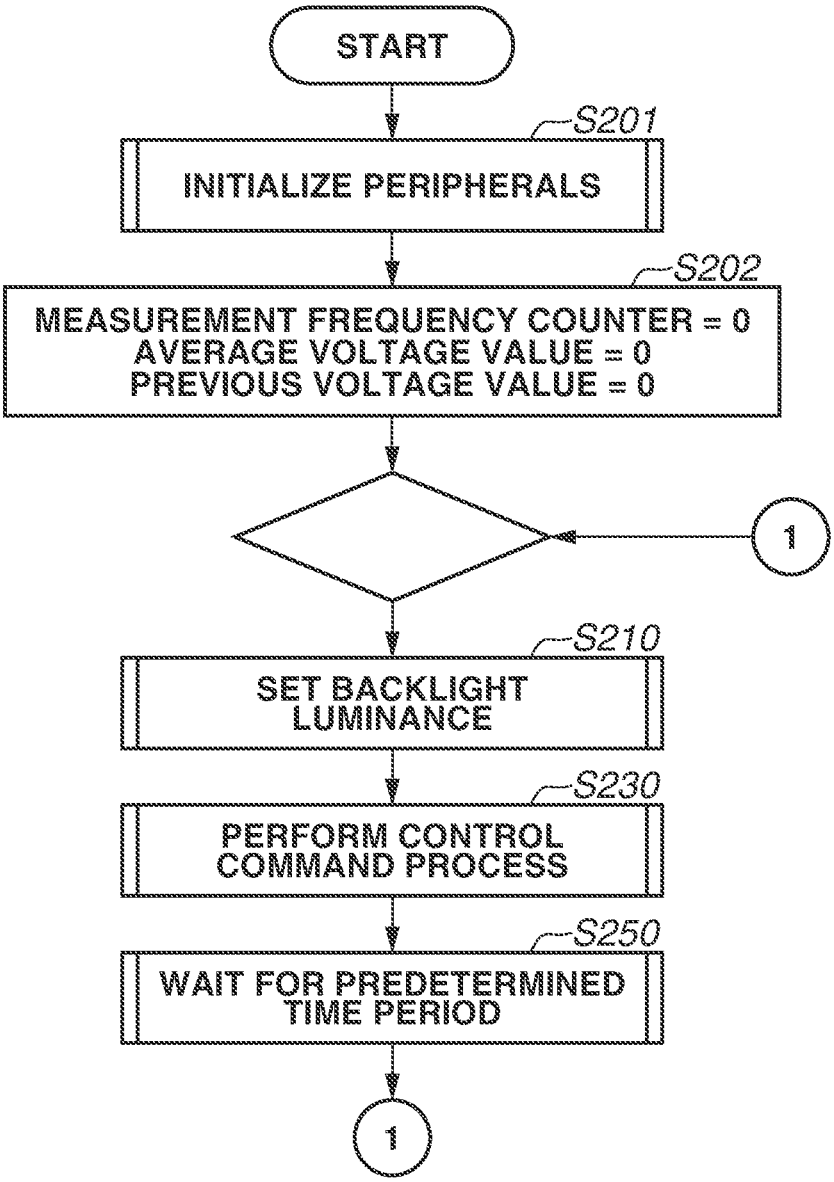
FIG. 2 is a flowchart of a main routine of a microcomputer according to one embodiment.

FIG. 2 is a flowchart illustrating processing executed by the microcomputer 110 of the operation unit 100.

In step S201, the microcomputer 110 performs an initialization process on internal and external peripherals of the microcomputer 110. For example, the microcomputer 110 initializes an interrupt setting. The microcomputer 110 sets a clock frequency indicating one cycle to the C1 timer 117. The microcomputer 110 makes initial settings to the A/D converter 118, and prepares for measurement of a voltage applied to the VBR terminal 116.

In step S202, the microcomputer 110 initializes a measurement frequency counter to zero, the average voltage value to zero, and the previous voltage value to zero.

In step S210, the microcomputer 110 measures and sets the luminance of the LED 142. The measurement and setting processes will be described in detail with reference to FIG. 3.

In step S230, the microcomputer 110 performs control command processing with the main unit 150. For example, when the UART 113 of the microcomputer 110 receives a display start control command from the UART 152 of the main unit 150, the LCD PON 114 outputs an ON signal. Thus, the FET 121 is turned on and power is supplied to the LED driver 120 and the LCD 140. Then, the UART 113 of the microcomputer 110 notifies a success as a control response to the UART 152 of the main unit 150. While omitted in the present exemplary embodiment for the sake of simplified description, a control command for buzzer control, a control command for power save mode control of the microcomputer 110, and the like may be supported. Besides, if the operation unit 100 includes a physical key, the microcomputer 110 may include processes of transmitting an event of press on the physical key as a control command to the main unit 150 and receiving a response as a control response to the command. These processes have little direct relation with the present embodiment and thus description of these processes will be omitted.

In step S250, the microcomputer 110 waits for a predetermined time period.

Figure 3A:
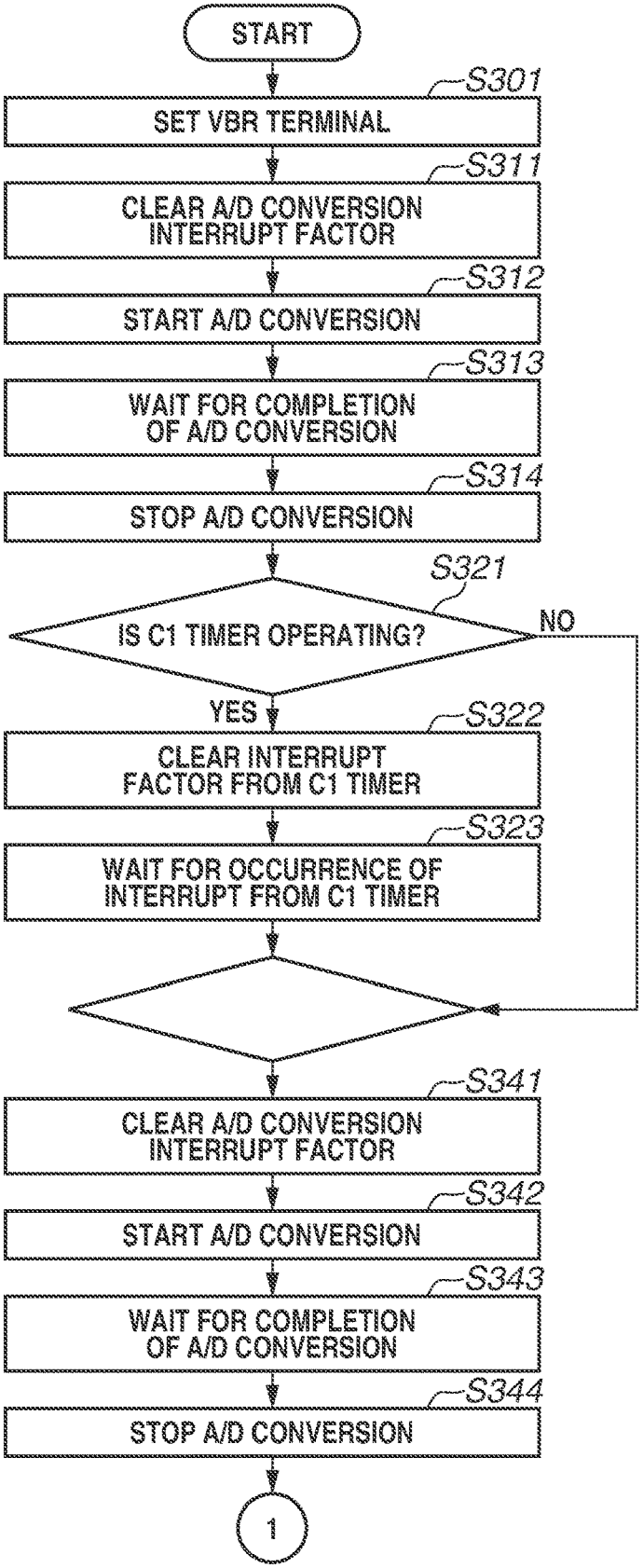
FIG. 3A is a flowchart of a backlight luminance setting routine according to one embodiment.
Figure 3B:
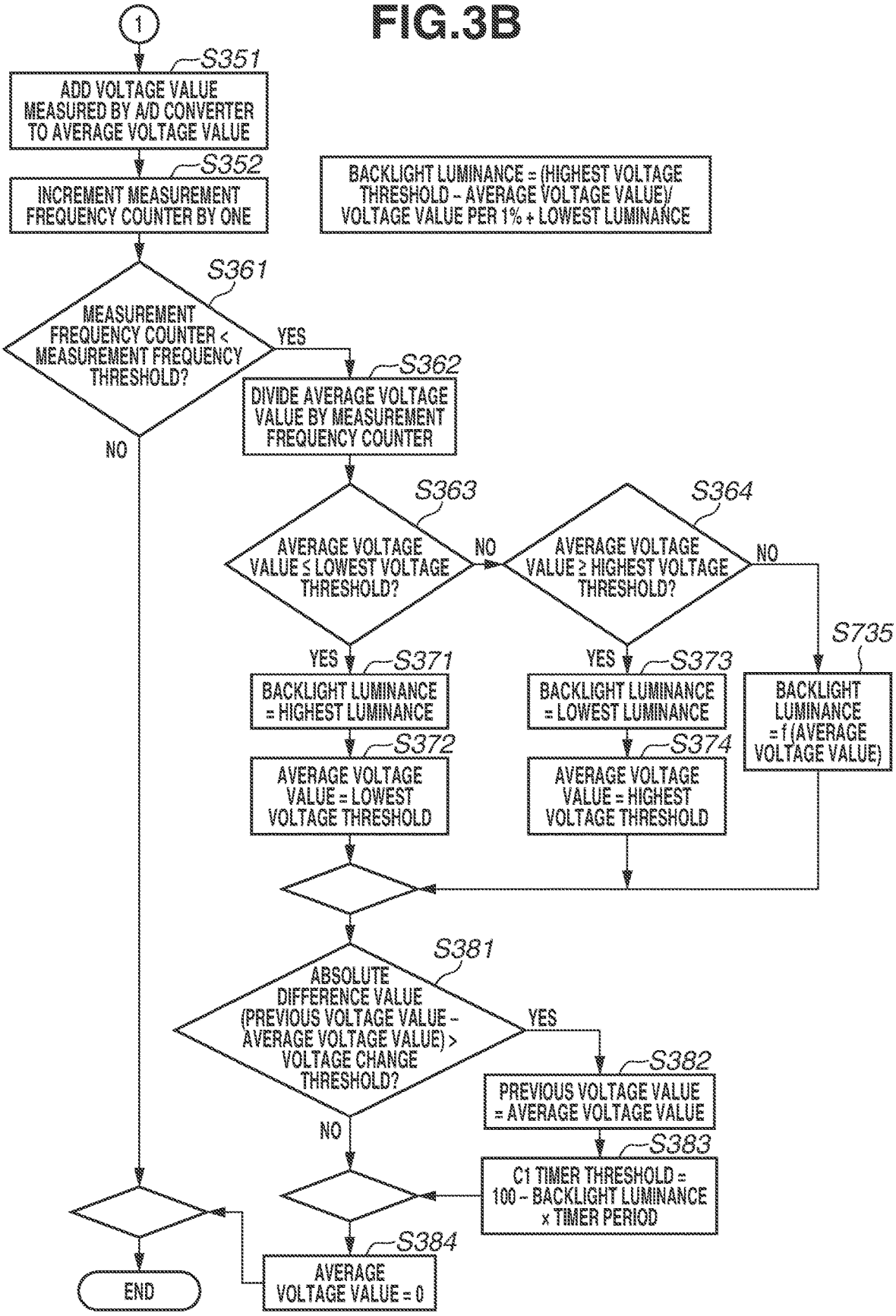
FIG. 3B is a flowchart of the backlight luminance setting routine according to one embodiment.

FIGS. 3A and 3B are flowcharts illustrating the details of step S210.

In step S301, the microcomputer 110 performs a setting process on the VBR terminal 116. In general, terminals in a microcomputer play a plurality of roles and are capable of being set as, for example, input/output ports and GPIO/INT. In various embodiments, the microcomputer 110 makes a setting for connecting the VBR terminal 116 and the A/D converter 118. In the present exemplary embodiment, a sequence of operations of abandoning the initial A/D conversion result and adopting the next A/D conversion result is used.

In step S311, the microcomputer 110 clears an A/D conversion interrupt factor. In step S312, the microcomputer 110 instructs the A/D converter 118 to start the A/D conversion. In step S313, the microcomputer 110 waits for the completion of the A/D conversion while waiting until an A/D conversion interrupt factor occurs. In step S314, the microcomputer 110 instructs the A/D converter 118 to stop the A/D conversion.

In step S321, the microcomputer 110 determines whether the C1 timer 117 is operating. In a case where the C1 timer 117 is operating, in step S322, the microcomputer 110 clears an interrupt factor from the C1 timer 117. Then, in step S323, the microcomputer 110 waits until an occurrence of an interrupt from the C1 timer 117. For example, the C1 timer interrupt occurs under the condition that the clock frequency counted by the C1 timer 117 has reached a threshold with which a signal set to the C1 timer 117 will be changed. Thus, in a case where the C1 timer 117 is operating, the CPU 119 issues an instruction for start of A/D conversion described below immediately after occurrence of an interrupt from the C1 timer 117. In a case where the C1 timer 117 is stopped, since the PWM driving of the backlight is also stopped, influence of input voltage changes due to the PWM driving will not take place. Thus, the CPU 119 proceeds straight to the A/D conversion start process.

Various modifications of this part are conceivable. For example, the microcomputer 110 may perform the process based on an interrupt triggered at a timing when the signal to the PWM controller 115 has changed from low to high. Alternatively, the microcomputer 110 may wait for a predetermined time period based on a timing when the signal to the PWM controller 115 has changed. Alternatively, the microcomputer 110 may observe the clock frequency of the C1 timer 117 and determine the timing without using an interrupt.

In step S341, the microcomputer 110 clears the A/D conversion interrupt factor. In step S342, the microcomputer 110 instructs the A/D converter 118 to start the A/D conversion. In step S343, the microcomputer 110 waits for the completion of the A/D conversion while waiting until occurrence of an A/D conversion interrupt factor. Then, in step S344, the microcomputer 110 instructs the A/D converter 118 to stop the A/D conversion.

Next, in step S351, the microcomputer 110 adds the voltage value measured by the A/D converter 118 to the average voltage value. Then, in step S352, the microcomputer 110 increments the measurement frequency counter by one.

In step S361, the microcomputer 110 determines whether the measurement frequency counter indicates a value less than a threshold. In a case where the measurement frequency counter indicates a value less than the threshold, the microcomputer 110 ends the process. The threshold can be designated as four, for example. In a case where the measurement frequency counter indicates a value equal to or more than the threshold, the processing proceeds to step S362. In step S362, the microcomputer 110 divides the average voltage value by the value indicated by the measurement frequency counter to calculate the average value.

In step S363, the microcomputer 110 determines whether the average voltage value is equal to or less than a lowest voltage threshold. In a case where the average voltage value is equal to or less than the lowest voltage threshold, the processing proceeds to step S371. In step S371, the microcomputer 110 sets the backlight luminance at a highest luminance, and in step S372, the microcomputer 110 sets the average voltage value at the lowest voltage threshold. For example, the lowest voltage threshold is 0.33 V, and the highest luminance is 100%.

In a case where the average voltage value is greater than the lowest voltage threshold, in step S364, the microcomputer 110 determines whether the average voltage value is equal to or greater than the highest voltage threshold. In a case where the average voltage value is equal to or greater than the highest voltage threshold, the processing proceeds to step S373. In step S373, the microcomputer 110 sets the backlight luminance at the lowest luminance, and in step S374, the microcomputer 110 sets the average voltage value at the highest voltage threshold. For example, the highest voltage threshold is 2.97 V, and the lowest luminance is 33%.

In a case where the average voltage value is smaller than the highest voltage threshold, the processing proceeds to step S375. In step S375, the microcomputer 110 calculates the backlight luminance from the average voltage value. For example, the microcomputer 110 calculates the backlight luminance by subtracting the average voltage value from the highest voltage threshold, then dividing the result of the subtraction by the voltage value per 1%, and then adding the lowest luminance to the result of the division. In the present exemplary embodiment, (2.97 V−0.33 V)÷(100%−33%)= 0.04 V/1%.

In step S381, the microcomputer 110 determines whether the absolute value of a difference between the previous voltage value and the average voltage value is more than a voltage change threshold. The previous voltage value is the average voltage value measured at when the C1 timer threshold has been set in the previous time. This process is performed to reduce the influence of noise and the like due to changes in the average voltage by discarding the changes to a certain extent. For example, a change in the voltage value equivalent to 1% is discarded.

In a case where the absolute value of the difference between the previous voltage value and the average voltage value is more than the voltage change threshold, the processing proceeds to step S382. In step S382, the microcomputer 110 updates the previous voltage value to the current average voltage value. In step S383, the microcomputer 110 determines a C1 timer threshold by subtracting the backlight luminance from 100% to calculate the duty ratio, and multiplying the duty ratio by a timer cycle.

In step S384, the microcomputer 110 initializes the average voltage value to zero.

By the above-described process, it is possible to almost certainly ensure that the A/D converter 118 will start the A/D conversion at a timing of when the PWM controller 115 performing the PWM control based on the C1 timer 117 has changed from high to low. This excludes the influence of changes in the input voltage that could result from the PWM control, and thus the difference between the previous voltage value and the average voltage value can be reduced.

Figure 4A:
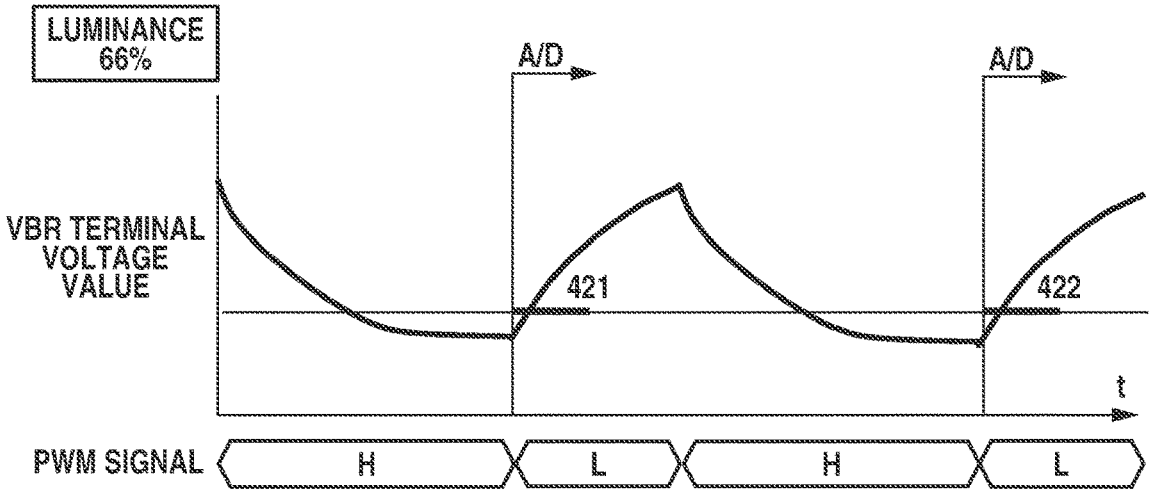
FIGS. 4A, 4B, and 4C are schematic diagrams representing the relation between pulse width modulation (PWM) control and a VBR terminal according to one embodiment.
Figure 4B:
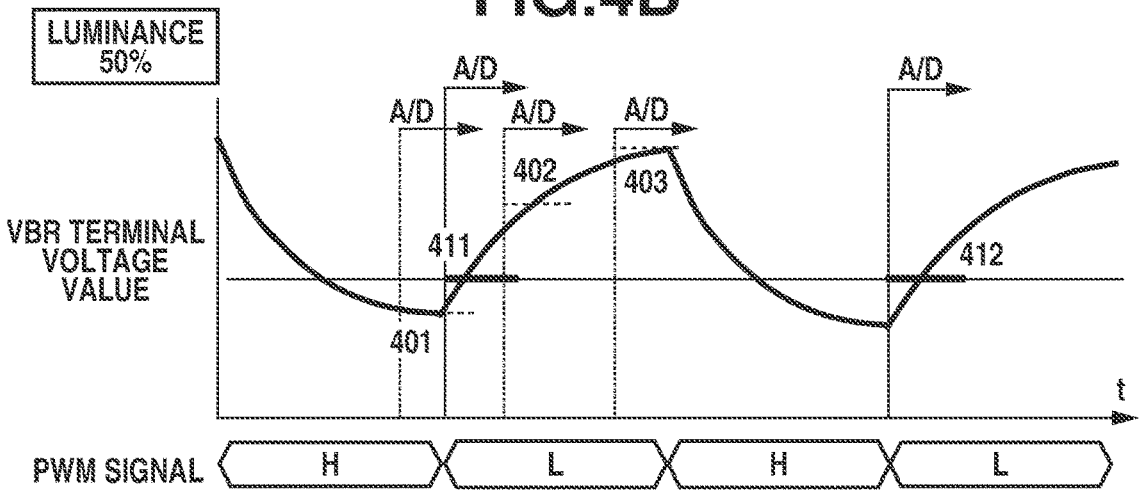
Figure 4C:
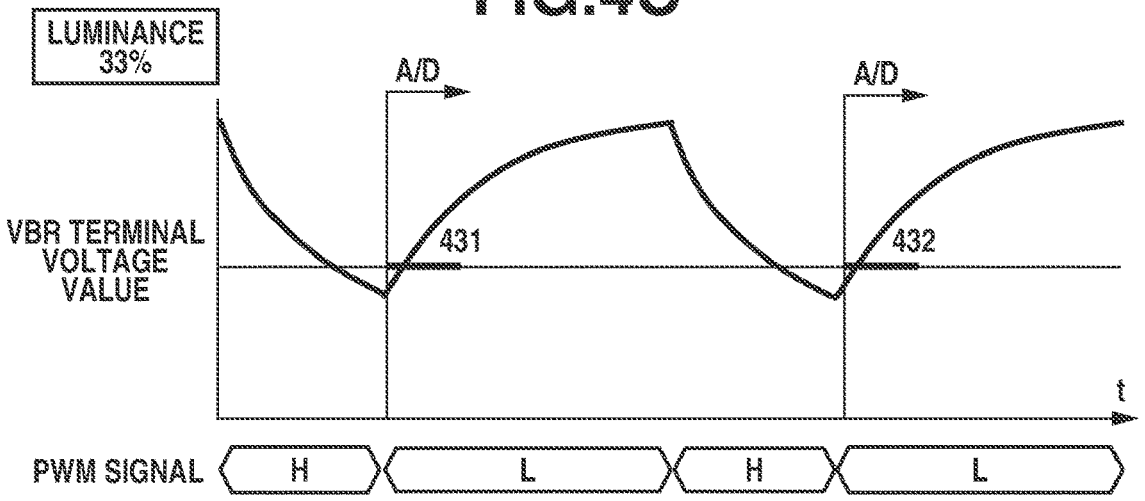

FIGS. 4A to 4B are schematic diagrams each representing the relation between the PWM control of the backlight and the voltage value of the VBR terminal. FIG. 4A illustrates a state where the backlight is operated with a PWM luminance of 66%, FIG. 4B illustrates a state where the backlight is operated with a PWM luminance of 50%, and FIG. 4C illustrates a state where the backlight is operated with a PWM luminance of 33%. The vertical axis indicates the voltage value of the power passed to the VBR terminal 116, and the horizontal axis indicates the elapsed time.

In an interval during which the PWM signal is high, the LED 142 is energized. As a result, electric current flows into the power line L. When the electric current flows to the power line L, a voltage drop occurs in the power line L due to a resistance value of the power line L. Thus, measured voltage values of the variable resistor 135 and the VBR terminal 116 connected to the power line L are low. In an interval where the PWM signal is low, electric current flowing to the power line L becomes small. Thus, a voltage drop in the power line L is small. Thus, the measured voltage value of the VBR terminal 116 is high.

For example, FIG. 4B will be referred to. In a conventional technology, since the microcomputer 110 performs various processes, there is no restriction on the timing for starting A/D conversion. Therefore, it is not uniquely determined which of timings to be selected, from among a timing 401 when the measured voltage value is the lowest to a timing 403 when the measured voltage value is the highest. For example, the change in voltage value between the timing 401 and the timing 403 is about 0.2 V, which is converted to an amount of change about 5% in the luminance of the LED 142. Thus, even though the luminance dial 130 is not operated, the voltage value of the VBR terminal 116 may vary depending on the timing for measuring the voltage value of the VBR terminal 116. Consequently, the LED 142 will flicker even without operation of the luminance dial 130.

In contrast to the conventional technology, in various embodiments of the present invention, the timing for the A/D converter 118 to start A/D conversion is limited to the timing of when the PWM signal is changed from high to low. This eliminates changes in the voltage of the VBR terminal 116 that would occur with the conventional technology. For example, the timing for the A/D converter 118 to start A/D conversion is limited to the timing of when the PWM signal is changed from high to low as illustrated with timings 411 and 412 in FIG. 4B. This reduces or prevents flickering of the LED 142 when the user does not operate the luminance dial 130.

When the user operates the luminance dial 130, the voltage value measured at the VBR terminal 116 changes and the timing of when the PWM signal changes from high to low also changes. Accordingly, the timing for the A/D converter 118 to start A/D conversion changes. For example, as illustrated in FIGS. 4A and 4C, with the PWM luminance of 66% and the PWM luminance of 33%, the timings for the A/D converter 118 to start A/D conversion do not match each other in one cycle. For example, the values of the voltages supplied to the VBR terminal 116 measured at the timings 411 and 412 are identical. The values of the voltages to the VBR terminal 116 measured at the timings 421 and 422 are identical and lower than the voltage value measured at the timing 411. The values of the voltages to the VBR terminal 116 measured at timings 431 and 432 are identical and higher than the voltage value measured at the timing 411.

Here, the merits of carrying out features of the present disclosure will be highlighted. Before that, a few means for solving the issue without carrying out the present embodiment of the present disclosure will be discussed.

For example, by excessively increasing the threshold that is used for the determination in step S361, the influence of the timings for A/D conversion can be reduced by averaging. In this case, however, when the user operates the luminance dial 130, the response of the LCD 140 to the operation will take a longer time. This brings the demerit of lowering user operability.

As another means, increasing the voltage change threshold that is used for the determination in step S381 eliminates the influence of changes in the average voltage. In this case, however, when the user operates the luminance dial 130, a larger rotation angle is required to obtain response of the backlight of the LCD 140 to the operation. This brings the demerit of lowering user operability.

As a radical resolution, it is desired to provide a stabilized power source that moderates voltage changes due to PWM control by a capacitor or the like. However, adding a circuit for reducing or preventing voltage changes will bring the demerit of increasing hardware cost.

As another resolution, providing separately a first power source connected to the backlight under PWM control and a second power source connected to the luminance dial and the voltage measurement terminal would prevent the influence of PWM control of the backlight from exerting on the voltage measurement terminal. In this case, however, this will also require a dedicated power source for the main unit that supplies power, thereby bringing the demerit of increasing hardware cost.

Preferably carrying out embodiments the present disclosure excludes the influence of PWM control on the A/D conversion. This suppresses fluctuations in measurements and obviates the necessity of increasing the threshold. This also eliminates the need for increasing the voltage change threshold more than being required. That is various embodiments of the present disclosure do not reduce user operability. Moreover, it is possible to avoid flicker due to changes in the backlight luminance when the user does not operate. No special hardware needs to be added in order to carry out various embodiments of the present disclosure, that is, in various embodiments, it is possible to provide products with identical functionality to the users at inexpensive prices.

As the first exemplary embodiment, a description is given of the configuration where voltage measurement is performed at identical timings in one cycle of the PWM control to exclude the influence of the PWM control.

Alternatively, the microcomputer 110 may observe an internal timer in the C1 timer 117 and continuously repeat measurements at timings corresponding to one cycle of the PWM control. By observing the internal timer, the microcomputer 110 can determine the present time is at which timing in one cycle of the PWM control. Based on this determination, the microcomputer 110 can repeat a plurality of measurements. Averaging the influence of voltage changes in one cycle excludes the influence of the measurement timings. This means for carrying out various embodiments of the present disclosure are also within the scope of the technology for controlling the voltage measurement timings based on the timer for PWM control in various embodiments of the present disclosure.

Other Exemplary Embodiments

In the first exemplary embodiment, the voltage of the variable resistor 135 is measured at the timing of when the PWM signal is change from high to low. Alternatively, the voltage of the variable resistor 135 may be measured with reference to the timing of when the PWM signal is changed from low to high. For example, the voltage of the variable resistor 135 may be measured at a certain time elapsed after the timing of when the PWM signal is changed from low to high.

In the first exemplary embodiment, the resistance value of the variable resistor 135 of the rotary type resistor is changed by the rotation of the dial for changing the luminance of the backlight. The variable resistor 135 is applicable to not only a rotary variable resistor but also a slider variable resistor. The rotary variable resistor has a metallic contact moving over a resistance element formed in a circular shape. A movement of the metallic contact changes the value of resistance between the contact fixed to the resistance element and the metallic contact. The slider variable resistor has a metallic contact moving over a resistance element formed in a linear shape. A movement of the metallic contact changes the value of resistance between the contact fixed to the resistance element and the metallic contact.

Instead of the rotatable luminance dial in the exemplary embodiment, a linearly movable member may be provided.

In the first exemplary embodiment, the luminance is changed. Alternatively, any factor other than the luminance may be changed as far as a variable resistor with a resistance value variable in accordance with a user operation is provided. For example, the sound volume (output intensity) of a sound output unit, such as a speaker, may be changed or a frequency received by a radio may be changed in accordance with a user operation. That is, the luminance dial may be a sound volume adjustment dial or a frequency change dial.

As the exemplary embodiment described above, an image forming apparatus has been described as an example of an electronic device. However, the electronic device in the exemplary embodiment of the present disclosure is not limited to an image forming apparatus. For example, in other embodiments, the electronic device in the exemplary embodiment of the present disclosure may be any of various electronic devices, such as note PC, tablet Ps, desktop PC, smartphone, automobile, air conditioner, game machine, and robot.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While exemplary embodiments have been described, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-069491, filed Apr. 8, 2020, which is hereby incorporated by reference herein in its entirety.

What is claimed is:

1. An electronic device comprising:

a variable resistor of which a resistance value changes in accordance with a user operation;

a load;

a power source that supplies power, via an electric current, to both the variable resistor and the load; and a controller that acquires information relating to a first measured voltage of the variable resistor and outputs a pulse width modulation (PWM) signal for turning on or off power supplied from the power source to the load, the PWM signal having a duty ratio determined based on the acquired information relating to the first voltage, wherein the PWM signal has a cycle, and the first voltage value is measured at a timing that is based on the cycle of the PWM signal.

2. The electronic device according to claim 1, wherein the controller acquires the information, based on a timing for inverting a logic state of the PWM signal during the cycle of the PWM signal.

3. The electronic device according to claim 1, wherein the load is a light emitter that outputs light, and wherein the electronic device further comprises a light emitter controller that controls light emission of the light emitter in accordance with the PWM signal.

4. The electronic device according to claim 3, wherein the power source applies a voltage to the light emitter and the variable resistor.

5. The electronic device according to claim 4, further comprising a liquid crystal panel, wherein the light emitter is a backlight of the liquid crystal panel.

6. The electronic device according to claim 5, further comprising a luminance dial that changes luminance of the backlight, wherein the variable resistor has a resistance value changing in accordance with rotation of the luminance dial.

7. The electronic device according to claim 1, wherein a substrate having the power source and a substrate having the variable resistor are different substrates.

8. The electronic device according to claim 1, wherein the variable resistor and the load are connected to the power source in such a manner that during a period when the electric current flowing from the power source to the load is below a threshold, a voltage of the variable resistor gradually increases, and during a period when the electric current flowing from the power supply to the load is below the threshold, the voltage of the variable resistor gradually decreases.

9. A control method of an electronic device, the electronic device including a variable resistor of which a resistance value changes in accordance with a user operation, a load, and a power source that supplies power, via an electric current, to both the variable resistor and the load, the control method comprising:

acquiring information relating to a first measured voltage of the variable resistor; and outputting a pulse width modulation (PWM) signal for turning on or off power supplied from the power source to the load, the PWM signal having a duty ratio determined based on the acquired information relating to the first voltage, wherein the PWM signal has a cycle, and the first voltage value is measured at a timing that is based on the cycle of the PWM signal.

10. The control method according to claim 9, wherein the variable resistor and the load are connected to the power source in such a manner that during a period when the electric current flowing from the power source to the load is below a threshold, a voltage of the variable resistor gradually increases, and during a period when the electric current flowing from the power supply to the load is below the threshold, the voltage of the variable resistor gradually decreases.

* * * * *